United States Patent [19]

Watanabe et al.

[11] Patent Number: 4,630,813

[45] Date of Patent: Dec. 23, 1986

[54] METHOD OF AND DEVICE FOR DETECTING DISPLACEMENT OF PAPER SHEETS

[75] Inventors: Toshiyuki Watanabe, Tokyo; Noboru Yamada, Yokohama, both of Japan

[73] Assignee: Kabushiki Kaisha Toshiba, Kawasaki, Japan

[21] Appl. No.: 636,290

[22] Filed: Jul. 31, 1984

[30] Foreign Application Priority Data

Nov. 28, 1983 [JP] Japan ..... 58-222234

[51] Int. Cl.[4] ..... B65H 7/02

[52] U.S. Cl. ..... 271/227; 271/259; 271/265

[58] Field of Search ..... 271/259, 265, 227, 228, 271/261

[56] References Cited

U.S. PATENT DOCUMENTS 3,743,277 7/1973 Bolza-Schunemann et al. ... 271/227
4,201,378 5/1980 Hams ..... 271/261
4,438,917 3/1984 Janssen et al. ..... 271/261 X

FOREIGN PATENT DOCUMENTS 2913410 10/1980 Fed. Rep. of Germany .
2005634 5/1983 Fed. Rep. of Germany .
55-21192 2/1980 Japan .
58-34114 7/1983 Japan .
1323868 7/1973 United Kingdom .
1542016 3/1979 United Kingdom .

*Primary Examiner*—George E. A. Halvoss
*Assistant Examiner*—Lawrence J. Goffney, Jr.
*Attorney, Agent, or Firm*—Schwartz, Jeffery, Schwaab, Mack, Blumenthal & Evans

[57] ABSTRACT

A displacement detection device which detects the displacement of a paper sheet in transit in a paper sheet sorter that picks up and transports the paper sheet such as the bank-notes. The displacement detection device includes photo sensors which detect the leading edge of the paper sheet that is being transported, and a photo position detector which detects the distance from the conveyer belt to the side edge of said paper sheet. Each of said photo sensors comprises of a light emitter and a light receiver which are arranged on opposite sides of the paper sheet. The photo position detector is placed on the downstream side in the conveyance direction of the photo sensors, extending perpendicularly to the conveyance line, and comprises a light projector and a light receiver with linear form and equal length arranged symmetrically with respect to the paper sheet. Signals from the photo sensors and photo position detector are processed by a microcomputer to determine the passing interval, the inclination, and the lateral shift of the paper sheet.

10 Claims, 20 Drawing Figures t1
t2
W
W

Bar Graph for Current File of the Card Patch

Number of cards measured: 957
Number of cards passed by: 957
Number of cards within Allowable range: 956
Average: 199.702
Standard deviation: .250522

Bar Graph for Current File for the Card Skew

Number of cards measured: 957
Average: 1.17429

Number of cards passed by: 957

Number of cards within allowable range: 957

Standard deviation: .162426

Bar Graph for Current File of the Card Shift

Number of cards measured: 957
Average: .2385

Number of cards Passed by: 957

Number of cards within allowable range: 957

Standard deviation: .0783516

METHOD OF AND DEVICE FOR DETECTING DISPLACEMENT OF PAPER SHEETS

BACKGROUND OF THE INVENTION

1. Field of the Invention

The present invention relates to a method of and device for detecting displacement of paper sheets in transit by a device which transports the paper sheets and stacks them according to the classification of the sheets.

2. Description of the Prior Art

In recent years, devices have been put into practical use which manage to sort out paper sheets such as bank-notes, checks, and stock certificates and stack them in prescribed numbers according to their classifications. Such a device, for example, a bank-notes sorter, works as follows. When bank-notes are set in a supply unit of the machine, a picker thereof picks up bank-notes one by one from the supply unit and places it on a conveyer belt. During conveyance, the inspection unit of the machine examines prescribed items about the bank-notes as well as counts their number. At the terminus of the conveyer system, a classifying gate and a stacking device segregate the bank-notes according to the kinds and pile them up in prescribed numbers at the stacking unit, based on the results of the inspection and counting.

In the bank-notes sorter described in the above, the final object is that the classification and stacking of the bank-notes are achieved with high reliability by carrying out accurate inspection and counting at the inspection unit. Therefore, displacement (referred to as "card skew" hereinafter) or off-centering (referred to as "card shift" hereinafter) of the bank-note at the inspection unit is undesirable due to the fact that it tends to reduce the reliability of the device. Moreover, even if the displacement or shift of the bank-note was checked accurately at the inspection unit, the bank-note might still undergo a displacement subsequent to completion of inspection and counting before it reaches the classifying gate. In such a case, paper clogging at the classifying gate, might appear, preventing the machine from achieving the precise piling-up of the bank-notes in spite of the accurate inspection and counting. In addition, in case the distance between the bank-notes in transit is not large enough, the speed of classification of the bank-notes at the classifying gate cannot follow the rate of accumulation of the notes there. This makes; it impossible to have a precise piling-up of the bank-notes due to paper clogging and the like at the gate. Consequently, for precise inspection of the operation of the bank-notes sorter, a checking of the transporting distance, displacement, and shift of the notes is required with due consideration on their mutual relationship.

As a device which is capable of performing such a check on operation of the bank-notes sorter, it is conceivable, for example, to apply a displacement detection device with a sensor that can detect the position of the edges of the paper sheets, as shown in Japanese Patent Publication No. 118605/1981 filed by the present applicant. With this displacement detection device, an accurate displacement detection of the bank-notes on real time is performed while they are being transported. On the other hand, an attempt to apply the displacement detection device to the operation check of the bank-notes sorter faces the following difficulties. Namely, because the sensor for obtaining the information on the edges of the paper sheets is arranged in the same direction as that of the conveyance of the paper sheets, the size of the displacement detector has to correspond to the length of the paper sheets, resulting in a large dimension of the structure. Because of this, for a conveyer stream with a complex mesh of belts, the displacement detector can be installed only at specially restricted spots so that the adjustment of the bank-notes sorter is usually time-consuming and its fine adjustment is often impossible.

SUMMARY OF THE INVENTION

An object of the present invention is to provide a displacement detection device for paper sheets which aid the reliability of processing and stacking functions of a conveyance and stacking device for paper sheets.

Another object of the present invention is to provide a displacement detection device for paper sheets which allows a quick and precise check of the operation of a conveyance and stacking device for paper sheets.

Another object of the present invention is to provide a smaller diplacement detection device for paper sheets.

Yet another object of the present invention is to provide a displacement detection device which is easily set up at a desirable spot on a conveyance line of a conveyance and stacking device for paper sheets.

Still another object of the present invention is to provide a displacement detection device for paper sheets which has an extremely high degree of manageability.

Another object of the present invention is to provide a displacement detection device for paper sheets which detects the positional irregularity of the paper sheets more precisely.

Briefly described, these and other objects of the present invention are accomplished by the provision of an improved displacement detection device comprising a paper sheet detection device which detects the interval with which each of the paper sheets passes at a prescribed location on a conveyance system for picking up and transporting the paper sheets, and a paper state detection device which is arranged at a location downstream from the paper sheet detection device in the conveyance system for detecting the state of the paper sheets, such as the inclination or the lateral shift, relative to the conveyance system. In this displacement detection device, the paper state detection device is so arranged as to start operation after an elapse of time, as calculated from the distance on the conveyance system between the paper sheet detection device and the paper state detection device and the conveyance speed of the conveyance system, during which the paper sheets passes the paper sheets detector and arrives at the paper state detection device.

BRIEF DESCRIPTION OF THE DRAWINGS

These and other objects, features, and advantages of the present invention will be more apparent from the following description of a preferred embodiment, taken in conjunction with the accompanying drawings, in which.

DESCRIPTION OF THE PREFERRED EMBODIMENTS

Figure 1:
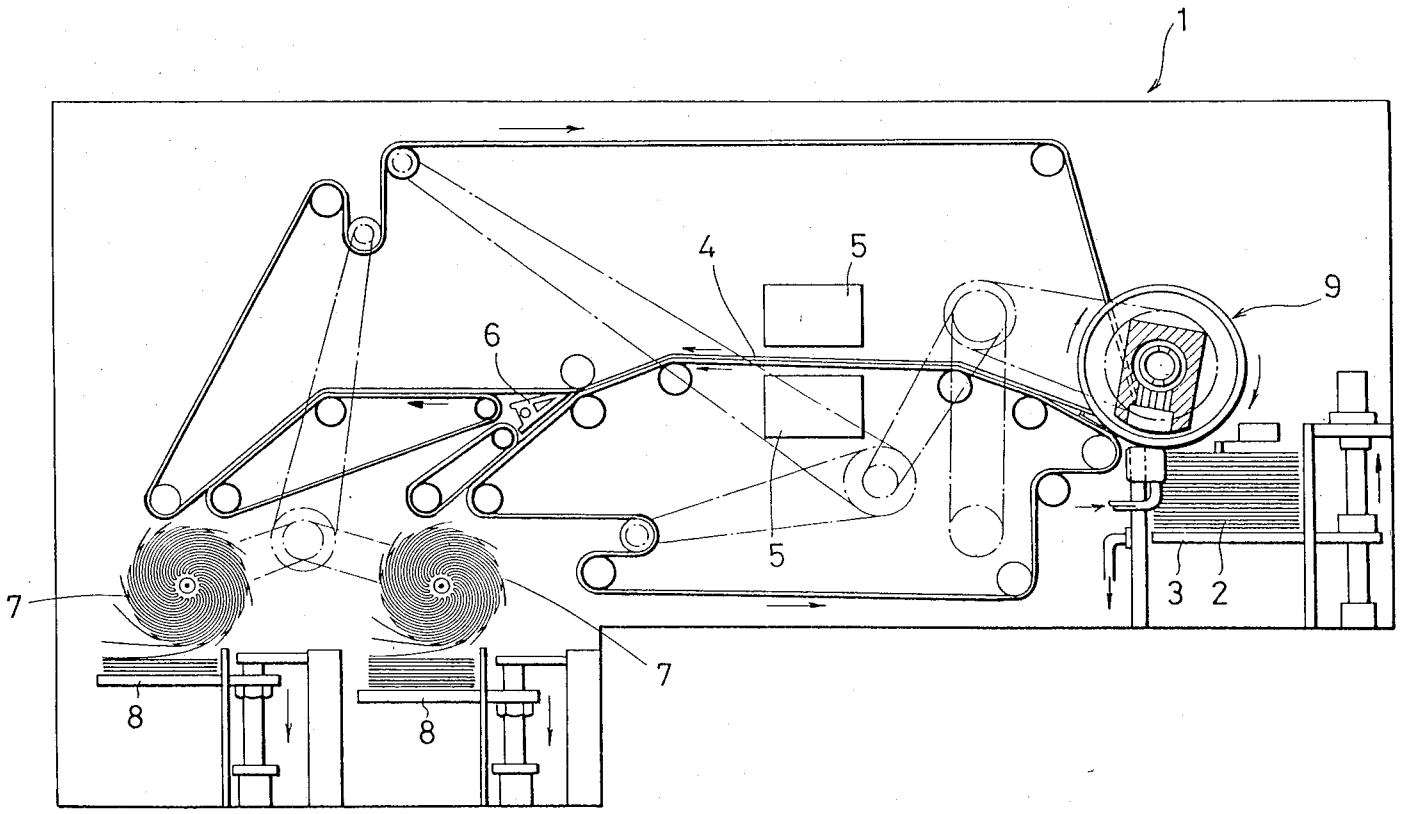
FIG. 1 is a schematic side view of a bank-notes sorter.
Figure 2:
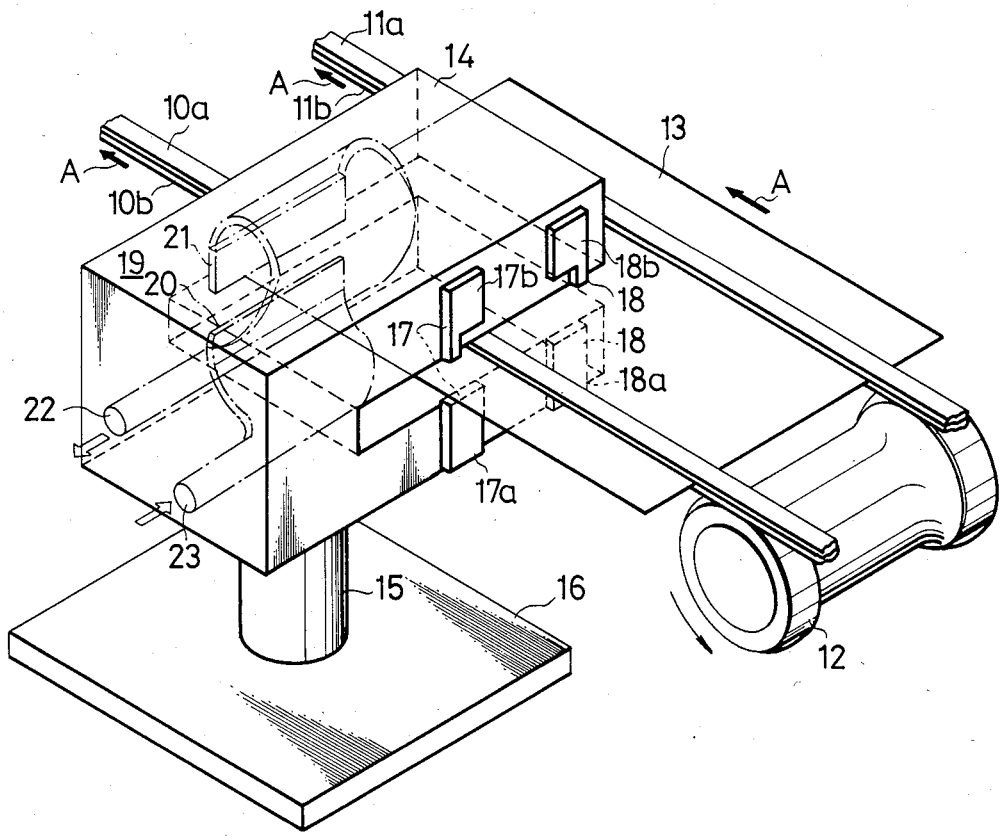
FIG. 2 is a schematic perspective view of a displacement detection device embodying the present invention and applicable to the bank notes sorter.

Referring to FIG. 1, there is shown the construction of a bank-notes sorter for employing a displacement detection device. The bank-notes sorter 1 includes a supply unit 3 in which bank-notes 2 are set, a picker 9 which picks up the bank-notes 2 one at a time from the supply unit 3 and places it on conveyer belts 4, an inspection unit 5 which performs prescribed inspections of the bank-notes 2 and counts the bank notes while they are in transit, and a classifying gate 6 and a stacking device 7 which classify the bank-notes 2 according to the kinds and stack them in prescribed numbers at stacking units 8 based on the results of the inspection and counting. Referring now to FIG. 2, there is shown a displacement detection device 14 embodying the present invention. The device is mobile and can be placed at a desirable location on a bank-notes conveyance line of the conveyer belts 4 of the bank-notes sorter 1.

As shown in FIG. 1, the two pairs of conveyer belts 10*a*, 10*b* and 11*a* and 11*b* are constructed so as to run in caterpillar fashion in the direction indicated by the arrows A, guided by a roller 12. A paper sheet 13 like a bank-note is transported in the direction of arrows A by being interposed in between the belts.

The displacement detection device 14 is provided with a supporting shaft 15 and a base platform 16. The base platform 16 is unfixed so that the displacement detection device 14 is free to move.

The displacement detection device 14 includes photo sensors 17 and 18 which detect the leading edge of the transported paper sheet 13, and a photo position detector 19 which detects the distance from the conveyor belts 10*a* and 10*b* to the side edge of the paper sheet 13.

The photo sensors 17 and 18 are constructed with light emitters 17*a* and 18*a* and light receivers 17*b* and 18*b*, wherein the light emitters and light receivers are arranged on the opposite sides of the paper sheet 13. Namely, the detection of the leading edge of the paper sheet 13 is done by detecting the blockage of the light path from the light emitters 17*a*, 18*a* to the light receiver 17*b*, 18*b*. Therefore, by measuring the time interval between the signal changes at the beginning of light path blockage in the photo sensors 17 and 18, it is possible to determine the card pitch for the paper sheet 13 that will be described later.

The photo position detector 19 is located in the downstream side of the conveyance line from the photo sensors 17 and 18, and is constructed with a line-shaped light projector 20 and a light receiver 21 of equal length arranged symmetrically relative to the sheet 13 and extending perpendicularly to the conveyance line. The light projector 20, for example, has a construction in which optical fibers with diameter of 0.25 mm is arranged parallel to form a square of width 1 mm and length 30 mm, for projecting the light, transmitted from a light source which is not shown in the figure via a light transmission cable 23, to the light receiver 21 in the form of a line. The light receiver 21 comprises an image guide formed, for example, by arranging optical fibers of diameter 0.25 mm parallel in the shape of a square with width 1 mm and length 30 mm, similar to the light projector 20, and the light received by each optical fiber is output via a light transmission cable 22. The ends on the same side of the light projector 20 and the light receiver 21 are arranged at sides of the conveyor belts 10*a* and 10*b*. In this way, the shadow, formed by the portion of the transported paper sheet 13 extending beyond the sides of the belts 10*a* and 10*b* by blocking the light from the light projector 20, is projected on the light receiver 21. Therefore, the bright and dark lights received by each optical fiber of the light receiver 21 are transmitted via each piece of the optical transmission cable 22. The transmitted light is input into a linear CCD image sensor via an imaging lens, which is not shown in the figure, and is then converted photoelectrically to be input into an operational processing unit which is described hereinafter.

The principle of measuring the conveyance attitude of the paper sheet in transit (namely, the card skew and the card shift), by the use of the displacement detection device 14 of the above construction will now be described briefly.

Figure 3:
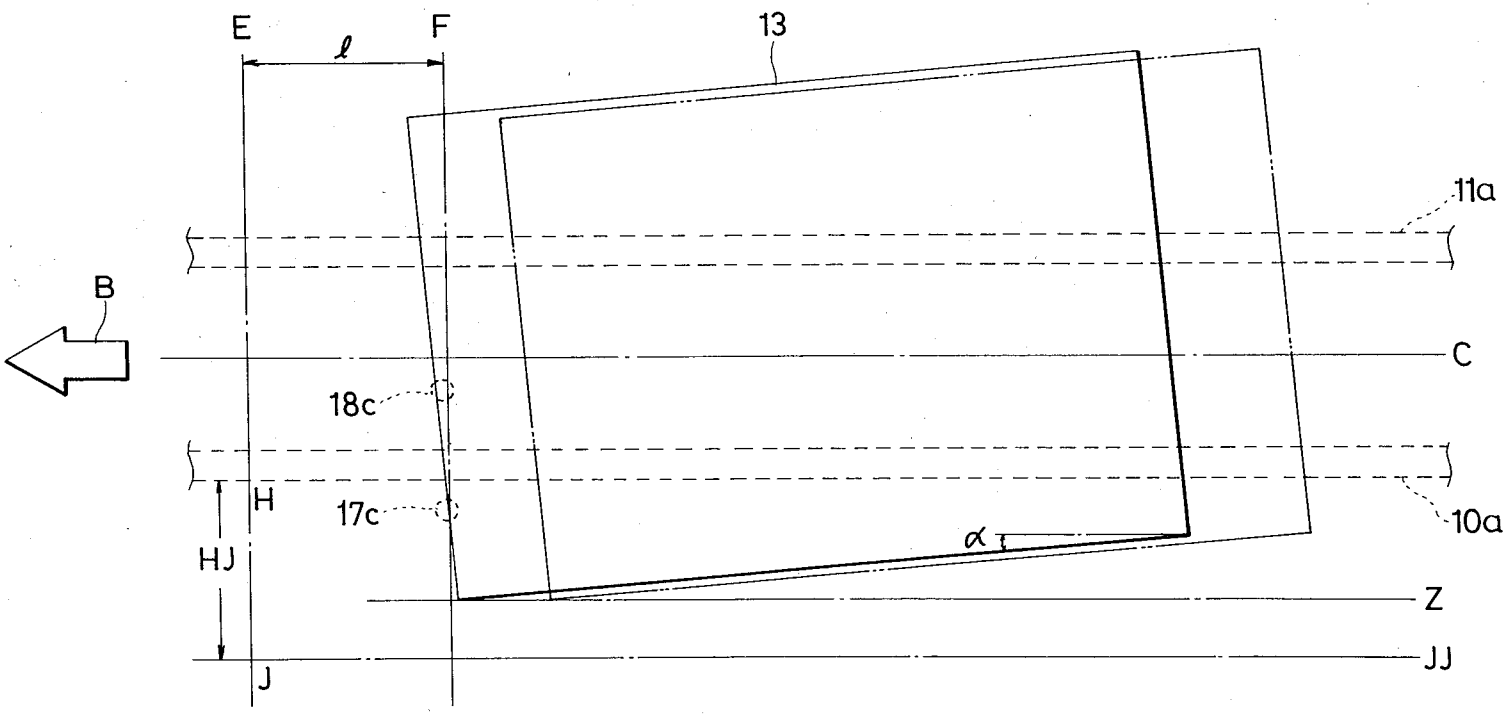
FIG. 3 is a diagram illustrating the principle of detecting the paper sheets displacement in the displacement detection device shown in FIG. 2.

Referring to FIG. 3, there is shown the state of the paper sheet 13 in transit in the direction of the arrow B with an inclination of $\alpha$, being caught by the conveyor belts 10*a*, 10*b* and 11*a*, 11*b*. In the FIG. 3, a dotted line C is a central line of the conveyor belts 10, 11, a dotted line E is a central line of the photo position detector 19, and a dotted line F is the line joining the photo sensors 17 and 18. The detection range of the light receiving 21 of the photo position detector 19 extends from the side edge H of the conveyor belt 10*a* to a point J, where the distance HF corresponds to the length of the light receiving section of the light receiver 21. Further, in FIG. 3, the cross sections 17*c* and 18*c* of the light passages from the light emitters 17*a* and 18*a* to the light receivers 17*b* and 18*b* are illustrated, respectively.

With the above arrangement, after a prescribed time $t_1$ following blockage detection of the light paths 17*c* and 18*c* of the photo sensors 17 and 18, signals detected by the light receiver 21 are taken out for six times, for example, at a prescribed interval $t_2$. For these six times of detection, the light receiver 21 outputs optical signals corresponding to the lengths ($y_1$ through $y_6$) of light from the light projector 20 which is not blocked by the portion of the paper sheet 13 in transit sticking out of the side edge of the conveyer belt 10*a*. Based on the signals corresponding to these lengths, the inclination $\alpha$ is determined by linear regression using, for example, the least squares method. With the inclination $\alpha$, the maximum displacement h of the paper sheet 13 can be determined, and in turn the card skew and the card shift can be sensed from the value of h, as detailed hereinafter. The reason for employing the least squares method for calculating the inclination $\alpha$ is to obtain appropriate values by absorbing the effects due to possible warping in the conveyance direction of the paper sheet 13 which are being transported at a high speed. Here, the prescribed time interval $t_1$, between the time of blocking the light paths 17*c* and 18*c* of the optical detectors 17 and 18 by the paper sheet 13 and the time of starting sampling of signals from the light receiver 21, is given by the following expression.

$$t_1 = \frac{l + 10}{v} \quad \text{[sec]}$$

Furthermore, the prescribed time interval $t_2$ with which continuous sampling of signals from the light receiver 21 is carried out subsequent to the start of sampling is given by the following expression.

$$t_2 = \frac{L - 20}{5v} \quad \text{[sec]}$$

Here, l is the distance [mm] on the conveyance line m between the photo sensors 17, 18 and the photo position detector 19, v is the speed [mm/s] of the conveyor belt 10, 11, and L is the length [mm] of the paper sheet 13. This means that the optical signals from the light receiver 21 are taken at five equally separated positions of the card except for the 10 mm from both ends of the paper sheet 13.

Figures 4A, 4B, 4C, 4D, 4E, 4F, 4G:
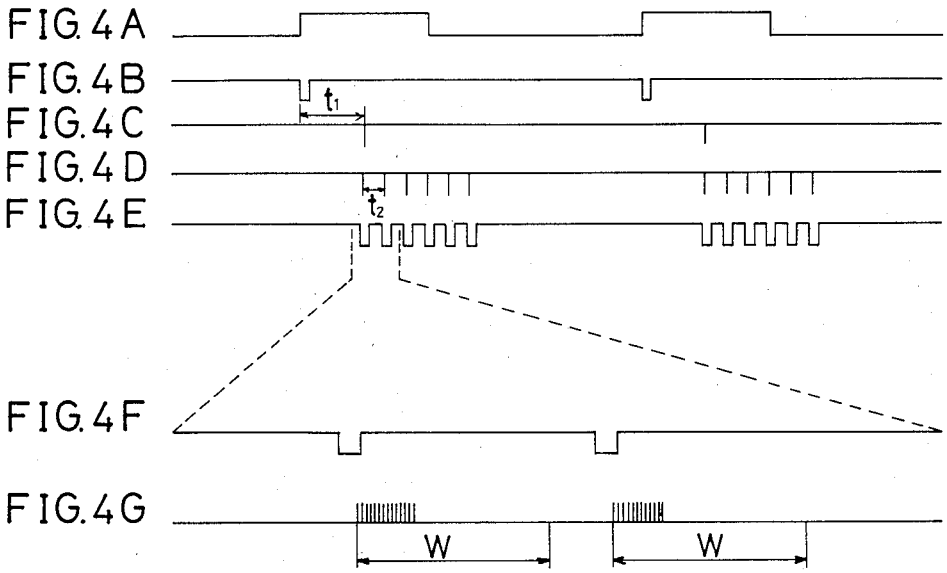
FIG. 4A is a waveform of the logical sum of the signals received at the photo sensors.
FIG. 4B is a series of starting pulses originating at the rising edge of the waveform in FIG. 4A.
FIG. 4C is a series of starting pulses generated in conjunction with the waveform of FIG. 4B.
FIG. 4D is a series of pulses for marking the timing of light detection.
FIG. 4E is a series of data pulses generated in conjunction with the timing pulses of FIG. 4D.
FIG. 4F is a portion of the signal input timing pulses.
FIG. 4G is a series of optical signals from a light receiver.

FIGS. 4A–4G show an example of time chart for the measurements explained above. The waveform shown in FIG. 4A represents the logical sum at the light receivers 17*b* and 18*b* of the photo sensors 17 and 18. The waveform shown in FIG. 4B is a series of one-shot pulses which occur at the rise of the logical sum signal. The waveform shown in FIG. 4C represents the starting pulses which are generated with a delay of prescribed time $t_1$ after generation of one-shot pulses, and cause to start the supply of detected signals from the light receiver 12. The waveform shown in FIG. 4D is a series of timing pulses which are generated at the same time as the starting pulses of FIG. 4C and mark the timing of detection by the light receiver 21 generated at a prescribed time interval $t_2$ for as many times as the detection signal input for example six times, from the light receiver 31. The waveform shown in FIG. 4E is a series of data pulses which are generated at the same time as the generation of the timing pulses with a pulse width larger than that of the timing pulses and mark the timing for inputting the detected signals at the light receiver 21 to the memory means or processing means which processes them for operation. Moreover, the waveform shown in FIG. 4F represents a portion of the signal input timing pulses. The waveform shown in FIG. 4E illustrates optical signals from the light receiver 21 which are converted photoelectrically by, for example, a line image sensor. Of the photoelectrically converted signals, the portion of the light receiving range W (corresponding to the distance HF of FIG. 3) of the image sensor corresponds to the optical signals that are output by the optical fibers of the light receiver 21 that are not screened by the paper sheet 13. That is, counting of the number of pulses with attention to their image magnification makes it possible to detect the length ($y_1$ through $y_6$). These data become of use in determining the lateral shift (the card shift) of the transported paper sheet 13 relative to the conveyer belt 10, 11.

Figure 5:
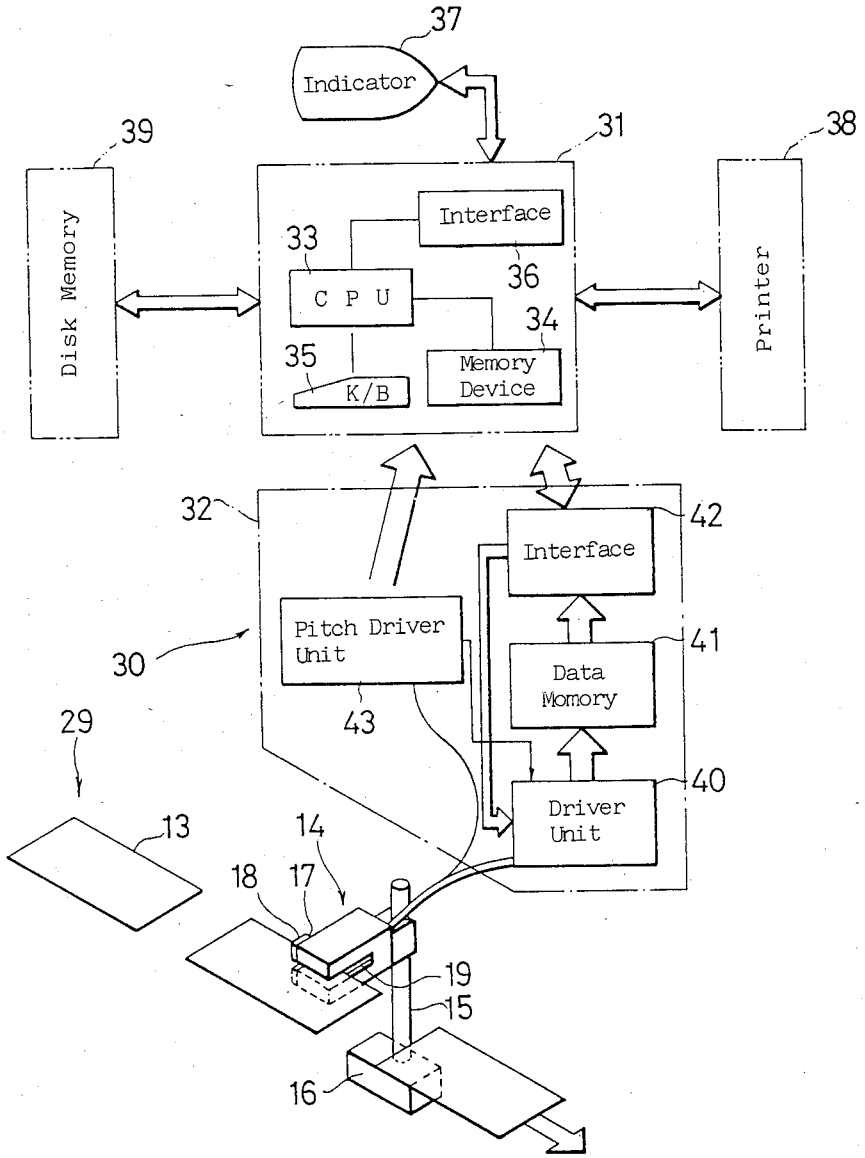
FIG. 5 is a diagram showing an example of a system which processes the detected signals from the displacement detection device shown in FIG. 2.

Next, referring to FIG. 5, an example of system operation in determining the card pitch, the card skew, and the card shift of the paper sheet by means of the displacement detection device 14 of the above construction will now be described. In the present example, the measurement and processing of data are handled by microcomputers.

First, the construction of the system will be explained briefly. Referring to FIG. 5, the displacement detection device 14 arranged on the conveyance line 29 of the paper sheet 13 is connected to a processing device 30. The processing device 30 includes a microcomputer 31 which calculates the conveyance interval (the card pitch), the inclination (the card skew), and the slip (the card shift) of the paper sheet 13, and a signal processing unit 32 which drives and controls the displacement detection device 14 and also outputs precisely the results of detection by the displacement detection device 14 into the microcomputer 31.

The microcomputer 31 includes a central processing unit (CPU) 33, a memory device 34, a keyboard 35, and an interface 36, and processes the detected results by the displacement detection device 14 according to the processing schedule that is explained later. In addition, as outside peripheral apparatus, an indicator 37, a printer 38, and a floppy disk 39 are connected to the microcomputer.

The signal processing unit 32 includes a driver unit 40, a data memory unit 41, an interface 42, and a pitch driver unit 43. The driver unit 40 is connected to the light projector 20 and the light receiver 21 which constitute the optical position detector 19 of the displacement detection device 14, for controlling the photo position detector 19 and converting the optical signals from the light receiver 21 into electric signals. These signals are fed to the data memory unit 41 and stored therein. To achieve these functions, the driver unit 40 includes a CCD line image sensor which converts the optical signals from the light receiver 20 into electric signals and an imaging lens which forms images with optical signals from the light receiver 20 on the image sensor. The imaging lens is arranged so as to have images from the light receiver 20 on the image sensor, reduced to $\frac{1}{2}$ of the actual size. By employing 1024 picture elements, where one picture element has the size of 15 $\mu$m square, as the image sensor, the measurement range of the image sensor becomes 30.72 mm (1024×15 $\mu$m×2) so that it can accept the whole of the images from the line region (a length of 30 mm) of the optical fiber arrangement of the light receiver 20. In more detail, the driver unit 40 is supplied beforehand with the information about the prescribed times $t_1$ and $t_2$ of FIG. 4 by the microcomputer 31. When signals as shown in FIG. 4B are input from the pitch driver unit 43, the driver unit 40 generates signals as shown in FIGS. 4C through E and receives the signals from the light receiver 21 through the help of the signal timing to convert them photoelectrically by the image sensor. Therefore the photoelectrically converted signals shown in FIG. 4G are counted by the counter and the results are memorized by the data memory unit 41.

The pitch driver unit 43 is connected with the light emitters 17*a*, 18*b* and the light receivers 17*b*, 18*b*, which constitute the photo sensors 17 and 18 of the displacement detecting device 14, so as to control the operation of the optical detectors and output the signals from the light receivers 17*b* and 18*b* with appropriate timing after reading them out. In more detail, upon receipt of signals as shown in FIG. 4A from the light receivers 17*b* and 18*b*, the pitch driver unit 43 generates signals as shown in FIG. 4B and outputs them to the driver unit 40. The interface 42 reads out one by one the data stored in the data memory unit 41 and outputs them to the microcomputer 31.

Figure 6A:
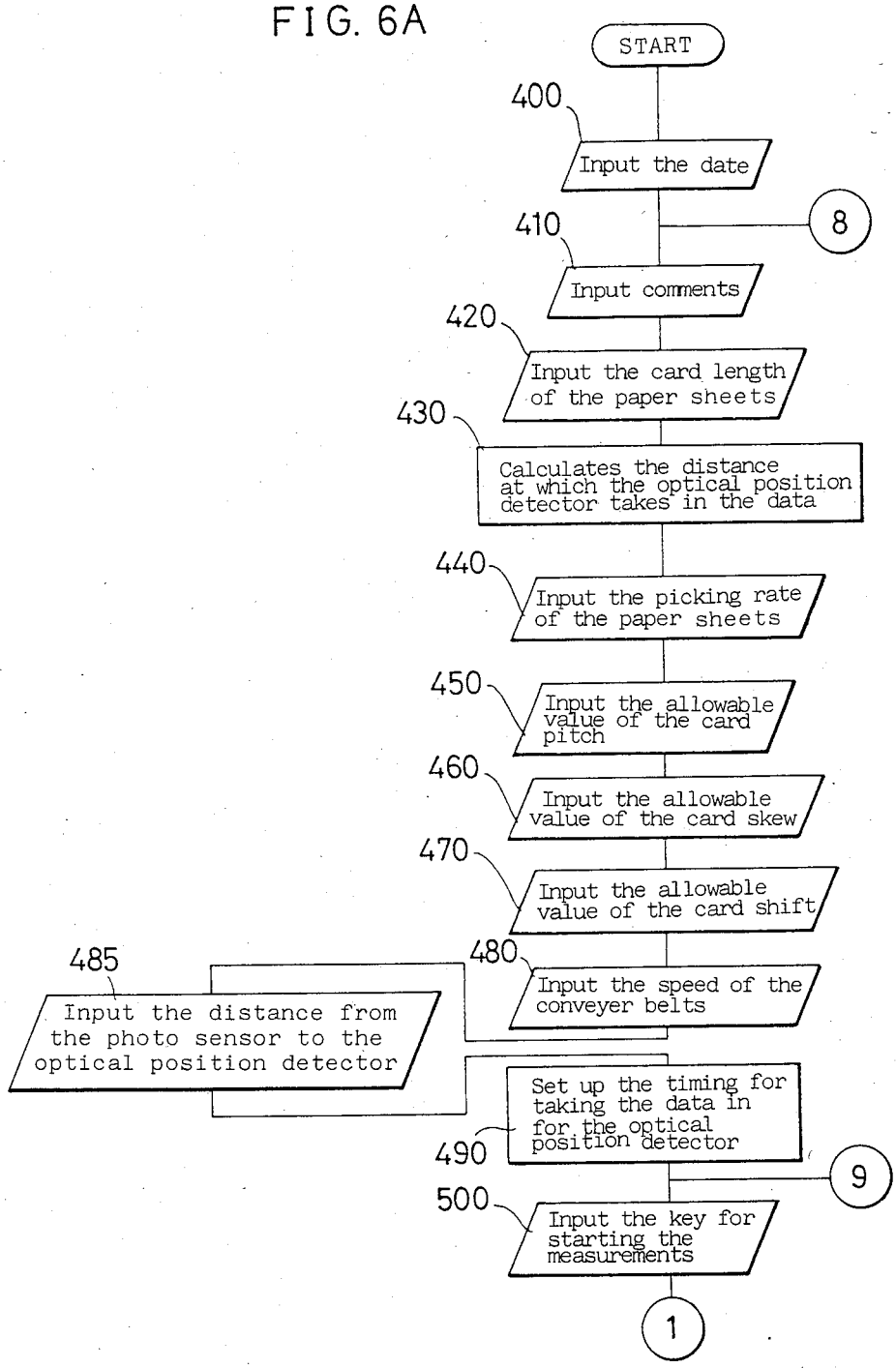
FIG. 6A is a flow chart for microcomputer processing of the system illustrated in FIG. 5.
Figure 6B:
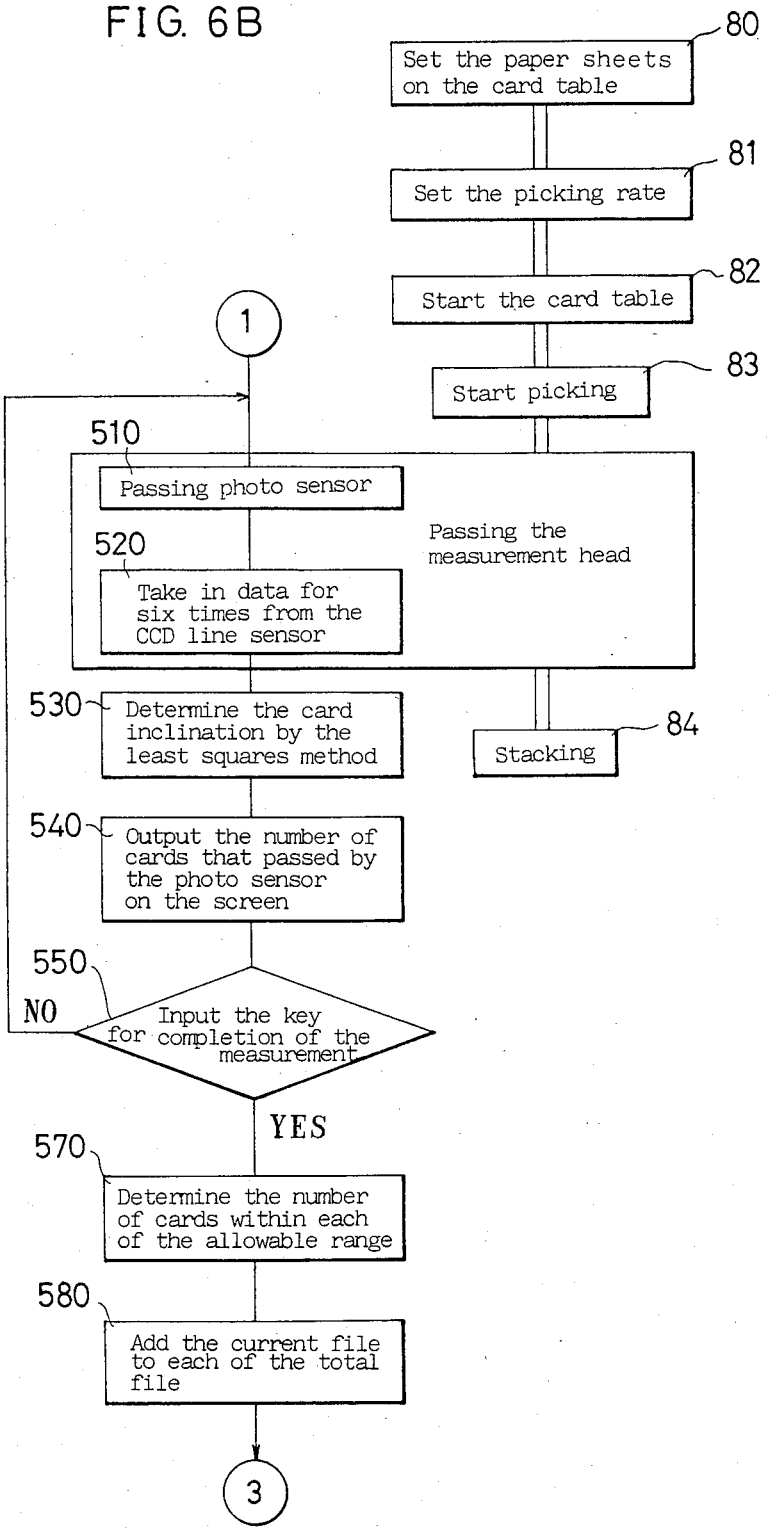
FIG. 6B is a flow chart for microcomputer processing of the system of FIG. 5.
Figure 6C:
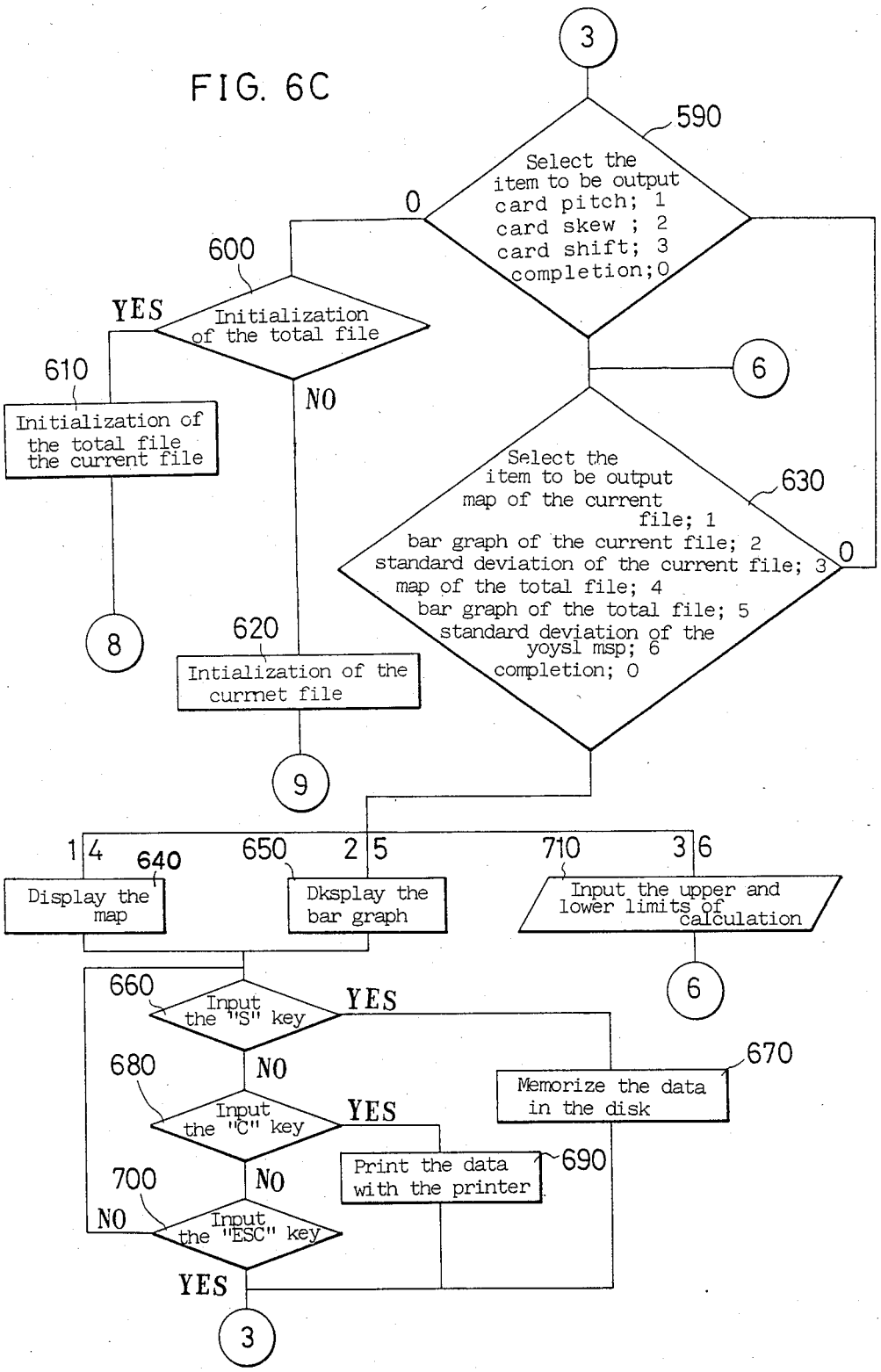
FIG. 6C is a flow chart for microcomputer processing of the system of FIG. 5.

Now, the operation of the system will be described by referring to FIGS. 6A–6C which illustrate the processing flow charts for CPU 33 of the microcomputer 31.

At the start of the measurements, CPU 33 processes the steps 400 through 490 as the initial set-up. Namely, by being input a date of measurement, prescribed comments, and a length of a paper sheet to be measured through the keyboard 35 by the key operation of the operator, CPU 33 sets up the distance from the leading edge of the paper sheet to the photo position detector 19 in the conveyance direction (steps 400 through 430). Further, upon being input the picking rate of the paper sheet, the allowable value of the card pitch, the allowable value of the card skew, the allowable value of the card shift, the speed of the conveyer belts, and the conveyance distance between the photo sensors 17, 17 and the photo position detector 19, CPU 33 sets up the times ($t_1$ and $t_2$ in FIGS. 4C and 4D) required for continuous samplings for six times of the output from the light receiver 21 (steps 440 through 490). The times ($t_1$ and $t_2$) set up in step 490 is then output to the driver unit 40 of the signal processing unit 32. Moreover, according to the present invention, the two kinds of sensors 17, 18 and 19 are formed into a single unit so that the input operation for the conveyance distance may be omitted if it is stored beforehand as a memory data.

An example of the data to be input for steps 410 through 480 is as follows.

| Comment input | BN |
|---|---|
| Length of the bank-notes to be examined (mm) | 160 |
| Picking rate (card number/minute) | 1500 |
| Allowable range of the card pitch (%) | 10 |
| Allowable valve of the card skew (±mm) | 5.8 |
| Allowable value of the card shift (±mm) | 2 |
| Speed of the conveyer belt (m/s) | 8 |

When the initial set-up described in the above is completed, upon input of the prescribed signal for the start of measurements from the keyboard 35 based on the key operation by the operator, CPU 33 proceeds to step 510 to begin the measurements and processing of the card pitch and the card skew.

Furthermore, upon key operation by the operator, for initiating measurement, it is assumed that the placing of the paper sheet on the card platform of the supply unit and the input of the data for the picking rate of the paper sheets have already been set up (steps 80 and 81). Also, following the key operation by the operator for the start of measurements, processing of the paper sheets 13, including picking up of the paper sheet, transporting and processing them on the conveyance line, and stacking them up at a prescribed stacking site or the stacking unit, is started (steps 82 through 84).

Proceeding to step 510, based on the signal corresponding to the presence of absence of the paper sheets 13 supplied by the photo sensors 17 and 18 of the displacement detection device 14 via the pitch driver unit 43, CPU 33 counts the number of the paper sheets 13 which passed through the sensors 17 and 18 to output the result to the indicator 37, and also memorizes the card pitch as the time required for transporting over the distance between the consecutive pieces of the paper sheets 13 (steps 510 through 540).

Figure 7:
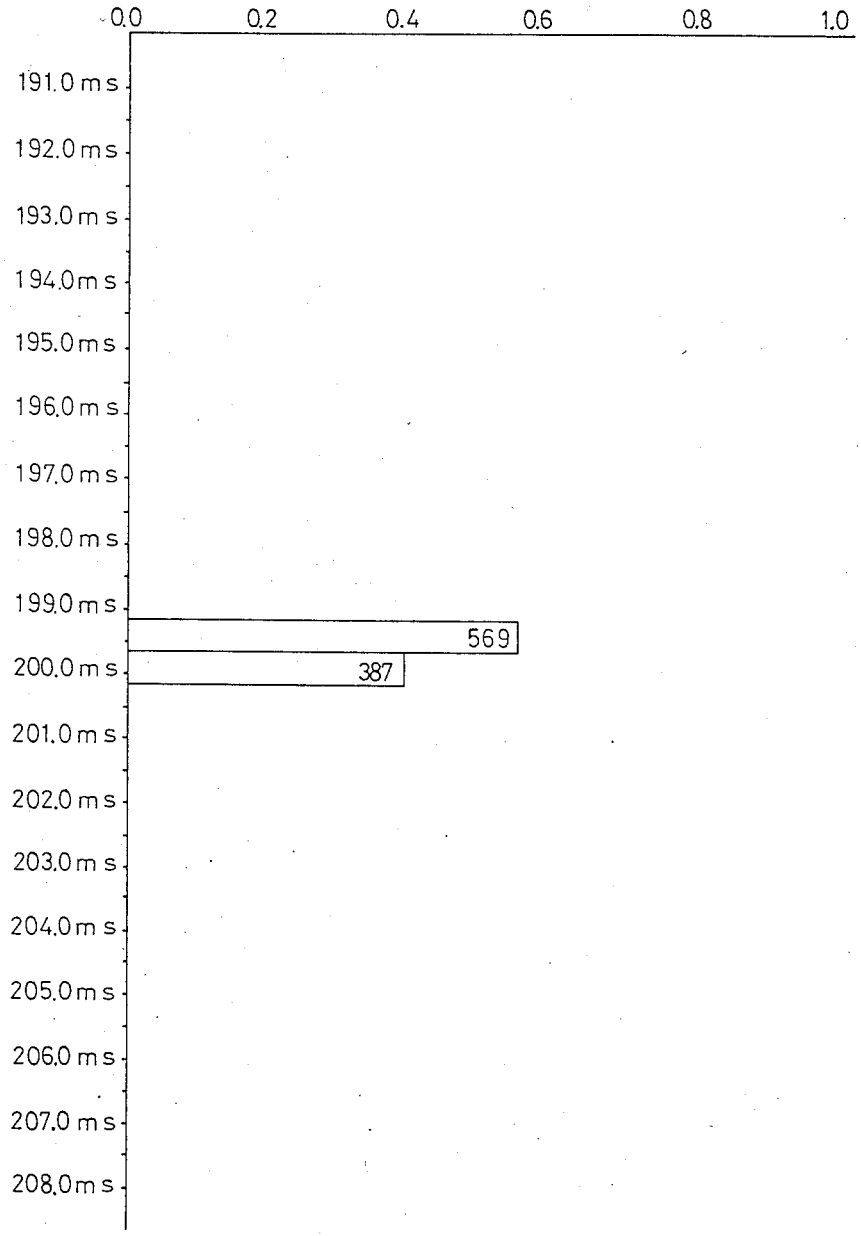
FIG. 7 is a diagram showing an example of the output display of the current file for the card pitch.
Figure 8:
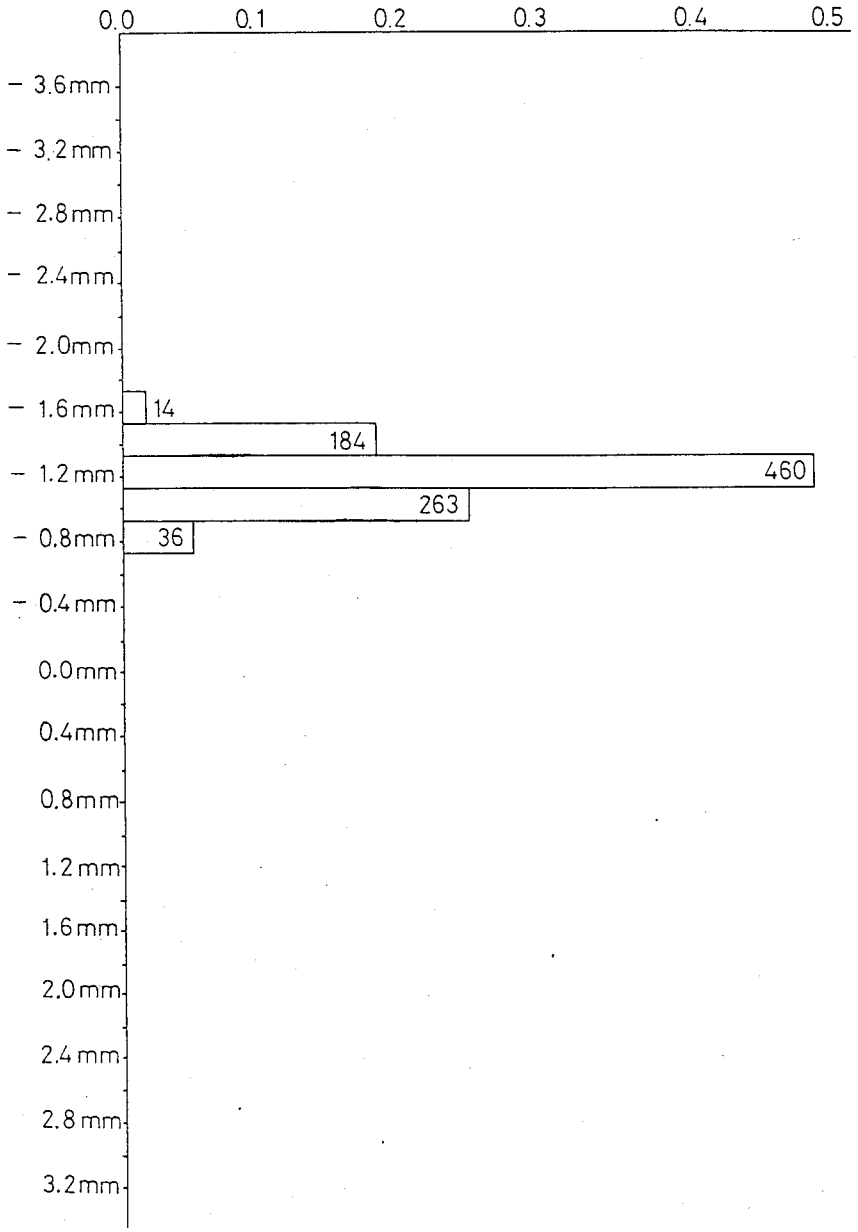
FIG. 8 is a diagram showing an example of the output display of the current file for the card skew.

On the other hand, based on the prescribed times ($t_1$, $t_2$) supplying to CPU 33 from the driver unit 40, CPU 33 reads via the interface 41 the results ($y_1$ through $y_6$) which have been detected by the six times of sampling of the light receiver 21 and have been stored in the data memory unit 41 (step 520). Based on the data read ($y_1$ through $y_6$), CPU 33 performs linear regression by the least squares method to determine the card skew and the card shift of the paper sheets 13 (step 530). Moreover, using the memory, though not shown in the figure, each of the three parameters (the card pitch, the card skew, and the card shift, is assigned memory address in advance, for each prescribed increment of the value. CPU 33 reads out the memorized value for each of the three parameters and increases the content of the address corresponding to the size of the value for each of the parameters as determined by the steps 510 through 540. Thus, by using of the content for each of the memory address, it is possible to obtain a current file of bar graph type, as shown in FIG. 7 for the card pitch, FIG. 8 for the card skew, and FIG. 9 for the card shift.

In more detail, the processing is done as follows. For the card pitch, a bar graph as shown in FIG. 7 is obtained for the frequency distribution of the conveyance pitch as classified for an increment of 0.5 m sec, based on the conveyance time for the distance. From the bar graph of the frequency distribution of the conveyance pitch, it can be seen that the card pitch of the conveyance system for the paper sheets is between 199.5 m sec and 200.0 m sec. By representing the displacement of the paper sheet at the i-th data as $y_i$, and the corresponding distance of the leading edge of the paper sheet as $x_i$, the inclination $\alpha$ of the paper sheet is given by the least squares method as follows.

$$\alpha = \frac{\sum_{i=1}^{n} x_i \cdot y_i - \frac{\sum_{i=1}^{n} x_i \cdot \sum_{i=1}^{n} y_i}{n}}{\sum_{i=1}^{n} x_i^2 - \frac{\left(\sum_{i=1}^{n} x_i\right)^2}{n}}$$

Here, n represents the number of measurements (=6). The maximum displacement h (see FIG. 3) corresponding to the inclination $\alpha$ is given by $$h = \alpha \cdot L \text{ [mm]}$$

where L is the length [mm] of the paper sheet. This means that the maximum displacement h of the paper sheet is calculated as a skew quantity relative to the reference line Z by taking the displacement of the side edge line of the paper stuff to be positive as in FIG. 3. A bar graph showing the occurrence frequency of the card skew classified for each interval of 0.2 mm within the measurement range of ±15 mm, as determined based on the maximum displacement h, is given by FIG. 8. An inspection of the graph shows that the card skew (the maximum displacement h) tends to occur with values between 0.8 mm and 1.6 mm with the side edge line of the paper sheet to be obtained by rotating the reference line Z clockwise. The card shift is processed as follows. The distance $Y_0$ from the limiting measurement line JJ of the line image sensor to an edge of the paper sheet is determined from the inclination of the paper sheet detected by the data processing described as above, by the following.

$$Y_0 = \frac{\sum_{i=1}^{n} y_i}{n} - \alpha \cdot \frac{\sum_{i=1}^{n} x_i}{n}$$

Next, the distance $Y_2$ from the limiting measurement line JJ to the central position of the paper sheet is given by the following.

$$Y_2 = \frac{2 \cdot Y_0 + h}{2}$$

Figure 9:
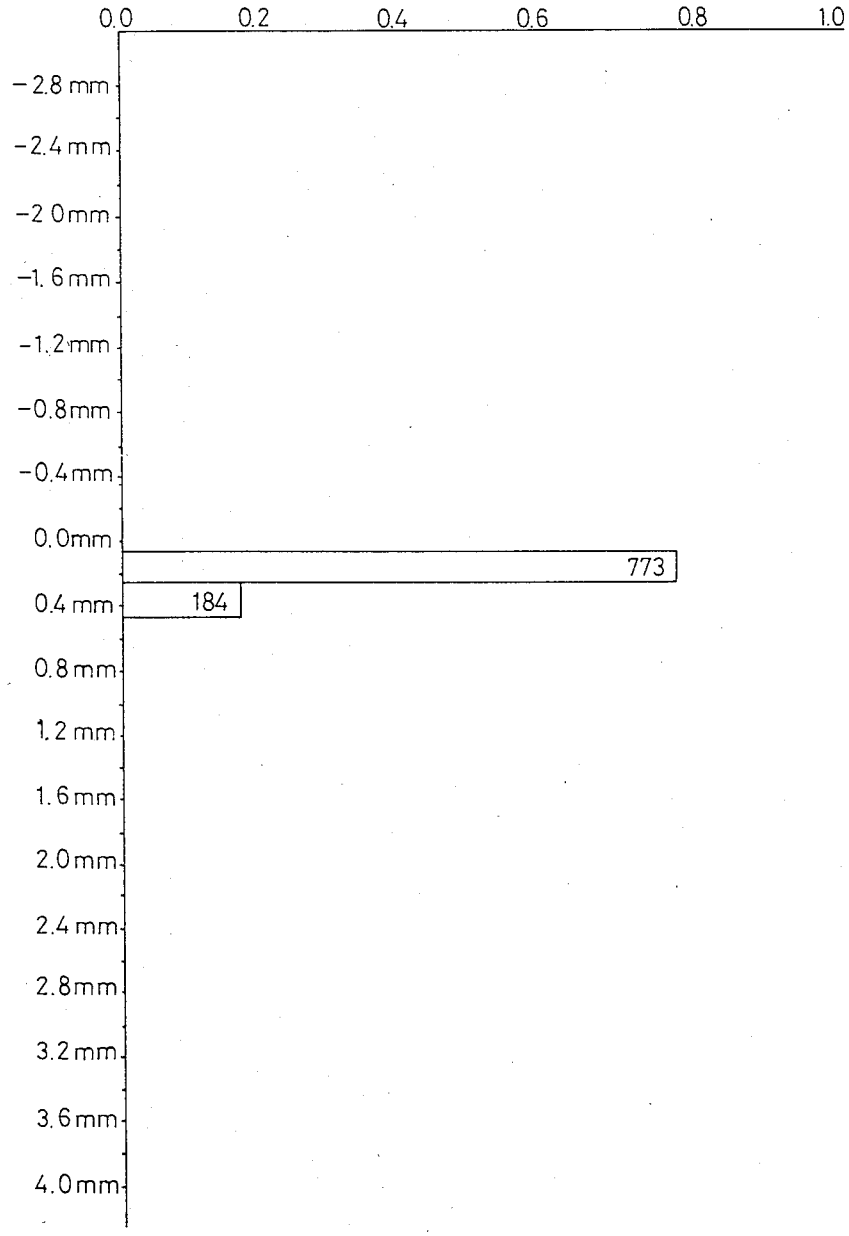
FIG. 9 is a diagram showing an example of the output display of the current file for the card shift.

By setting up the line at a distance $Y_0$ away and parallel to the limiting measurement line JJ (namely, the line Z in FIG. 3) as reference and by defining the central position of the paper sheet to be negative when it is to the side of the line JJ relative to the reference line Z, the amount of shift is calculated from the above two equations as the variation of the central position of the paper sheet relative to the reference line 2. Based on this displacement, the bar graph for the distribution of occurrence frequency of the card shift for intervals of 0.2 mm is obtained as shown in FIG. 9. From the graph, it can be observed that the card shift tends to occur at a magnitude between 0.2 mm and 0.4 mm with shift on the opposite side of the limiting measurement line JJ with respect to the reference line Z.

In step 550, a determination is made as to whether there exists a prescribed key operation which means, by the signal from the keyboard 35, the completion of the measurements. In case the result of the determination indicates no key operation, that is, there still remains some paper sheet to be measured, the processing goes back to step 510 and the processings as steps 510 through 540 are repeated. On the contrary, when there was the key operation, that is, when all of the paper sheet to be measured had been transported, the processing proceeds to step 570 and carries out the prescribed statistical processings, based on the data memorized in steps 530 and 540.

Proceeding to step 570, CPU 33 calculates, using the content of the current files for the card pitch and the like explained earlier, frequencies that correspond to the ranges of the allowed values at the time of initial set up about the card pitch, card skew, and card shift (step 570). In addition, CPU 33 adds the memory content for each of the current files to the memories of the total file for the card pitch, card skew, and card shift (step 580).

The operational processings relating to the card pitch, the card skew, and the card shift are now complete as described in the above, and the steps beyond 590 are those processings related to output and display of the results of the operational processings.

In step 590, CPU 33 distinguishes the signals from the keyboard, due to operation by the operator, of the numerical keys "0" through "3". And, except for the case where "0" was operated, it proceeds to step 630 to output signals for either the card pitch, the card skew, or the card shift. When "0" is operated, the CPU 33 proceeds to step 600, CPU 33 distinguishes whether there exists a demand for initializing the total file by examining the signal from the keyboard 35. When no such demand is found, the current file alone is initialized (step 620), and the processing goes back to step 500 to continuously carry out the measurements and operational processings relating to the card pitch and the card skew of the paper sheet at the same location on the conveyance line 29, and awaits for the arrival of the command for the start of the measurements. On the contrary, if there was a demand, after initializing the current file and the total file (step 610), the processing goes back to step 410 and starts to take measurements anew. Namely, it takes measurements by changing the condition set-up or takes measurements at a different location on the conveyance line 29 by moving the displacement detection device 14.

Processing to step 630, CPU 33 distinguishes the operation of the numerical keys "0" through "6" by the operator. As a result, the processing goes back to step 590 if "0" is designated, but proceeds to either one of steps 640, 650, or 710 to output or display the result of operation if any of keys "1" through "6" is operated.

If the numerical keys "1" and "4" are operated, CPU 33 outputs the current file map and the total file map, respectively, to the indicator 37 (step 640). If the numerical keys "2" and "5" are operated, CPU 33 outputs the bar graphs for the current file and the total file, respectively, to the indicator 37 (step 650).

When the map or the bar graph is output for display, CPU 33 finds itself in the state of waiting for arrival of a signal from the keyboard 35, and carries out processings for step 290 and beyond depending upon the operation of the key. Namely, if the key "S" is operated, CPU 33 lets the floppy disk 39 store the content of the displayed output (steps 660 and 670), and if the key "C" is operated, the content of the displayed output is sent to the printer 38 (steps 680 and 690). The state of waiting for an input is continued until the key "S", "C", or "ESC" is operated (step 700), and when one of these keys is operated, the processing goes back to step 590 to carry out display output and the like.

Furthermore, when the numerical key '3' or '6' is operated in step 630, CPU 33 proceeds to step 710 to calculate the standard deviation for the card pitch based on the current file or the total file after receiving an input as the range of the card pitch.

Accordingly, if the above system is applied to the operation check for the bank-notes sorter, it is possible to precisely and quickly check the operation of the bank-notes soter, by moving the displacement detection device 14 to a desirable location on the conveyance line of the bank-notes sorter and by displaying the displacement situation of the bank-notes as bar graphs and the like at that location.

Figure 10A:
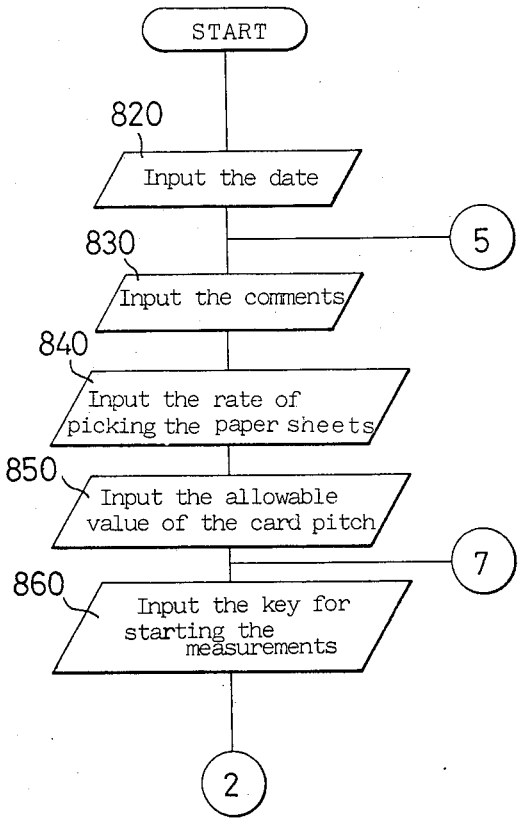
FIG. 10A is a flow chart for the microcomputer of FIG. 5.
Figure 10B:
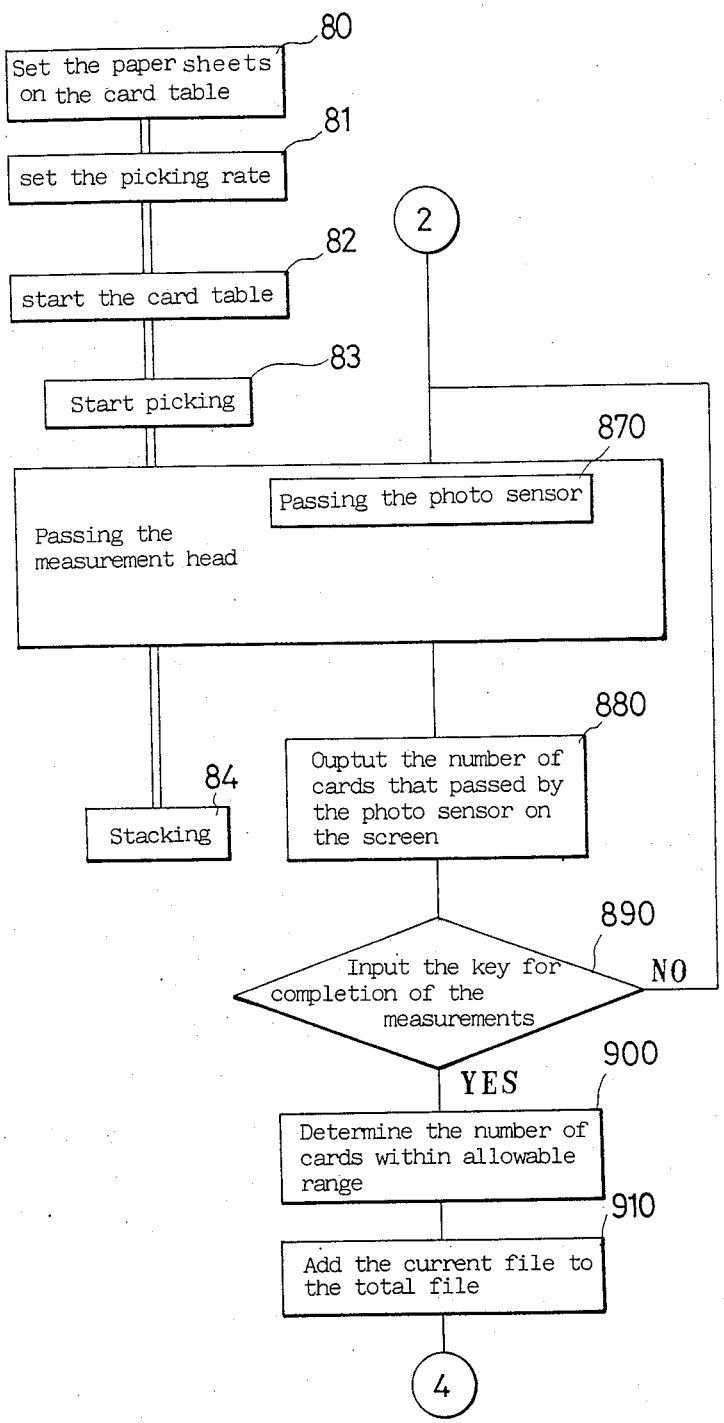
FIG. 10B is a flow chart for the microcomputer of FIG. 5.
Figure 10C:
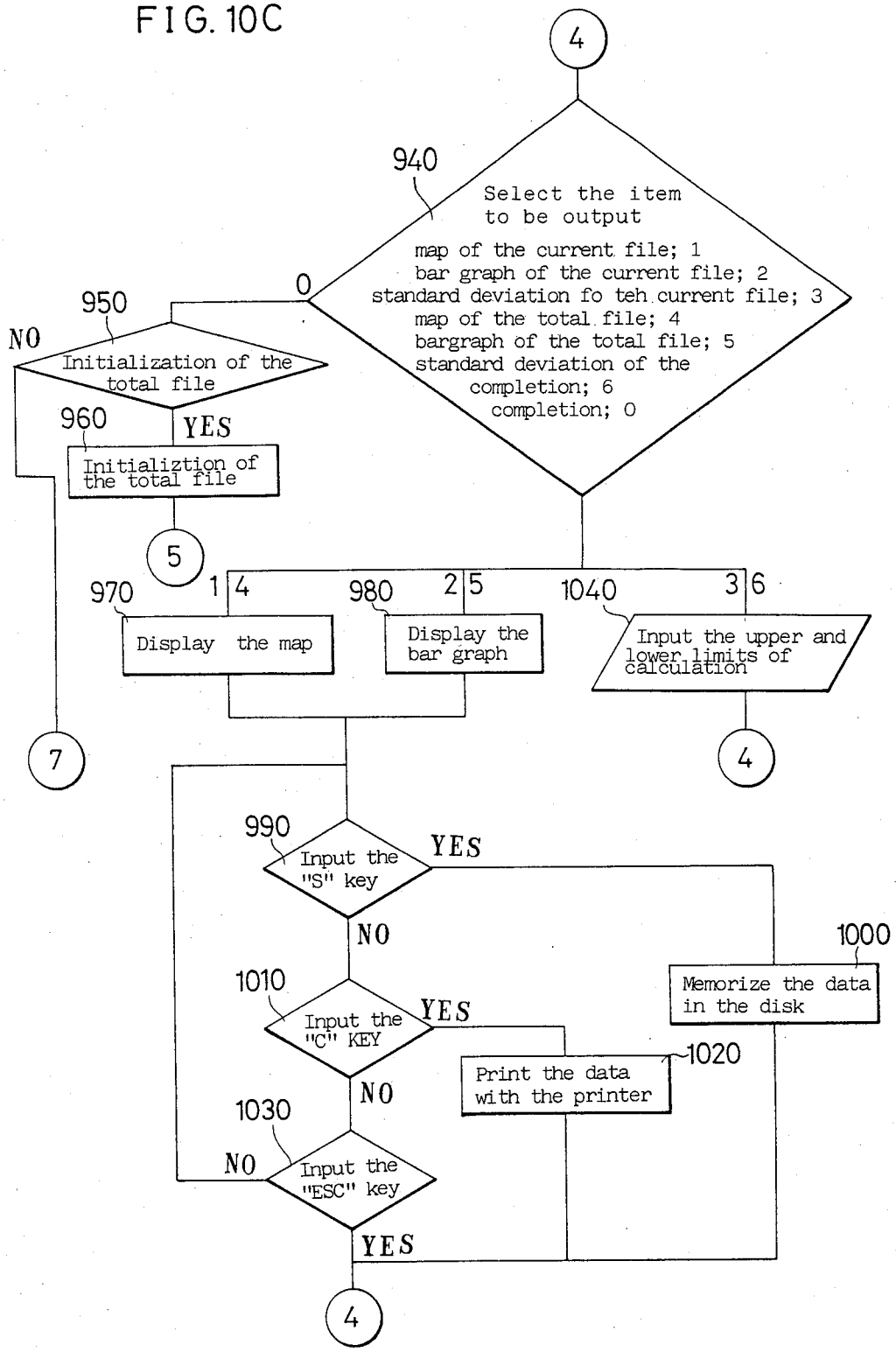
FIG. 10C is a flow chart for the microcomputer of FIG. 5.

FIGS. 10A–10C illustrate another flow chart for CPU 33 of the microcomputer 31. This flow chart corresponds to the case where the processing for the card pitch alone is done when the state of picking the paper sheet is desired.

Initially, the data of measurements, prescribed comments, picking rate of the paper sheet, and an allowable value of the card pitch are input to CPU 33 as the initial set-up by the key operation by the operator via the keyboard 35 (steps 820 through 850). Upon receipt from the keyboard 35 of a prescribed signal based on the key operation by the operator which indicates the start of the measurements, CPU 33 proceeds to step 870 to start measurements and processings for the card pitch (step 860). Here, it is assumed that the paper sheet has already been set on the card platform (not shown) and the picking rate of the paper sheet has also been set up (steps 80 and 81). Furthermore, when the key operation by the operator for starting the measurements is completed, a series of processings for the paper sheet, including the picking up of the paper stuff, transporting them on the conveyance line and carrying out the required processings, and stacking them at a prescribed site (not shown) according to the classification is started (steps 82 through 84).

Proceeding to step 870, based on the output signal corresponding to the presence or absence of the paper sheet which is found in transit by the photo sensors 17 and 18 of the displacement detection device 14 and is supplied via the pitch driver unit 43, CPU 33 counts the number of the paper sheet 13 which is passed through the photo sensor 17 and 18 and outputs the result to the indicator 37 and also memorizes the card pitch as the time required for transporting the paper sheet over the distance between two pieces of the paper sheet (steps 870 and 880).

In addition, using the memory, though not shown, to which an address is assigned according to each size of the prescribed constant range of the card pitch value, CPU 33 reads out one by one the previously memorized values of the card pitch and increases in step the content for the address corresponding to the size of the card pitch. Therefore, by examining the contents for each address of the memory, it is possible to find out the occurrence frequency of the card pitch at the time when the paper sheet 13 is passed by the photo sensors 17 and 18. Accordingly, by utilizing the content of the memory, it is possible, for example, to draw a bar graph type current file, as shown in FIG. 7, which gives the change in the frequency of the card pitch.

In step 890, CPU 33 distinguishes whether or not there is a prescribed key operation which indicates the completion of the measurements by the signal from the keyboard 35. If it is decided that no key operation was given, that is, there still remains some paper sheet to be measured, then the processing goes back to step 870 to carry out the processings for steps 870 and 880 explained earlier. If, on the contrary, there is a key operation, (i.e. when all the paper sheet were transported completely) CPU 33 proceeds to step 900 to execute the statistical processing relating to the card pitch, based on the data memorized in step 880.

Using the content of the memory for the current file of the card pitch described earlier, CPU 33 calculates the number of the paper sheet which is passed through the photo sensors 17 and 18 with values of card pitch within the allowable range that was supplied in step 850 of the initial set up (step 900). Further, CPU 33 adds the content of the memory for the current file to the memory for the total file relating to the card pitch of the paper stuff (step 910).

With the foregoing, the operational processings relating to the card pitch of the paper sheet 13 are complete so that step 940 and beyond are processings relating to the output and display of the results of these operational processings.

Upon distinguishing the signal from the keyboard 35 due to operation of the numerical keys "0" through "6" by the operator, CPU 33 proceeds to one of steps 950, 970, 980, and 1040 to output or display the results of the processings.

When it proceeds to step 950 through operation of the numerical key "0", CPU 33 judges, after distinguishing the signal from the keyboard 35, whether or not there exists a demand for initialization of the total file. If there is a demand, following the initialization (step 960), the processing goes back to step 830 in order to carry out measurements and operational processings anew, that is, to take measurements by changing set-up conditions or by selecting another location on the conveyance line 29, namely by moving the displacement detection device 14. If there was no demand, the processing goes back to step 860 to execute measurements and operational processings at the same location on the conveyance line 29 to await the input of a command for start of the measurements.

On the other hand, if the numerical key "1" (or "4") is operated, CPU 33 outputs the current file map (or the total file map) to the indicator 37 (step 970). Further, if the numerical key "2" (or "5") is operated, then CPU 33 outputs the bar graph for the current file (or the total file) to the indicator 37 (step 980). The explanation for the steps 990 through 1040 will be omitted since it is the same as for the steps 660 through 710 described earlier.

In summary, the displacement detection device according to the present invention is so arranged as to start measurements for a card skew by measuring beforehand and time for paper sheets to arrive from a pitch sensor to an image sensor, and to detect the card skew on a conveyance line of a conveyance and stacking device by sampling the information on the edge of the paper sheet at one of the side edges of the conveyance line. Therefore, it is possible to make the size in the conveyance direction of the paper state detection device to be small, enabling the sensing of fine states over the entirety of the conveyance line. Moreover, the state information of the three parameters (the card pitch, the card skew, and the card shift) can be measured with two sensors, and also, it is possible to measure, on real time basis, the paper sheet which is moving continuously following the actual motion of the conveyance and stacking device to display the state of the device at that time. Furthermore, by employing the displacement detection device whose detector part is small in size, it is possible to provide a detection apparatus with an excellent operability such that an inspection of any desired location on the conveyance line can be carried out. Accordingly, by employing a displacement detetion device of this invention, it is possible to make a quick and precise check on the operation of a device for transporting, sorting, and stacking of paper sheets, improving the reliability for handling and stacking functions of the device.

Various modifications will become possible for those skilled in the art after receiving the teachings of the present disclosure without departing from the scope thereof.

What is claimed is:

1. A displacement detection method of detecting the displacement of a paper sheet in transit along a conveyance line in a conveyance device, comprising:

detecting a leading edge of the paper sheet at a prescribed location of said conveyance line of the conveyance device for the paper sheet;

detecting a distance between one side edge of the paper sheet and a reference line set up traverse to the conveyance line based on a time interval after elapse of a prescribed time following the leading edge detection; and calculating a passing interval, inclination, and lateral shift to the paper sheet being transported based on the leading edge and distance detecting steps.

2. A displacement detection method for detecting displacement of paper sheets in transit, comprising the steps of:

(a) detecting a leading edge of each paper sheet at a predetermined location along a conveyance line of conveyance belts for conveying the paper sheets;

(b) detecting, after elapse of a predetermined time $t_1$ following the detection of a leading edge of each paper sheet, the distance between one side edge of the paper sheet and a reference line set up along the conveyance line;

(c) generating signals in response to said leading edge detecting and said distance detecting steps; and (d) measuring a passage interval, inclination ($\alpha$), and lateral shift ($Y_0$) of each paper sheet in transit in accordance with said signals.

3. The displacement detection method as claimed in claim 1, wherein said leading edge detecting step includes utilizing a sensing means, said distance detecting step includes utilizing a displacement detection means, and said distance detecting is carried out every time $t_2$ after elapse of the predetermined time $t_1$ following the detection of the leading edge of each paper sheet.

4. The displacement detection method as claimed in claim 1, wherein the step of measuring said passage interval, inclination, and lateral shift of each paper sheet further includes the step of performing a sampling of said signals for a predetermined number of times after the elapse of the time $t_1$.

5. The displacement detection method as claimed in claim 4, wherein said predetermined number of times of the sampling is six.

6. The displacement detection method as claimed in claim 3, wherein the step of measuring said passage interval, inclination, and lateral shift of each paper sheet further includes the step of determining the time $t_1$ and the time $t_2$ in accordance with the following equations;

$$t_1 = \frac{l + 10}{V}$$

$$t_2 = \frac{L - 20}{5V}$$

where l=the distance between the sensing means and the displacement detection means, L=the length of the paper sheet, and V=the feeding speed of the conveyance belts.

7. The displacement detection method as claimed in claim 3, wherein the step of measuring said passage interval, inclination, and lateral shift of each paper sheet further includes the step of calculating the inclination ($\alpha$) of the paper sheet in question in accordance with the following equation:

$$\alpha = \frac{\sum_{i=1}^{n} x_i \cdot y_i - \frac{\sum_{i=1}^{n} x_i \cdot \sum_{i=1}^{n} y_i}{n}}{\sum_{i=1}^{n} x_i^2 - \frac{\left(\sum_{i=1}^{n} x_i\right)^2}{n}}$$

where $y_1$=the displacement of the paper sheet at the i-th sampling, $x_i$=the distance from the leading edge of the paper sheet in question, n=the number of samplings or measurements.

8. The displacement detection method as claimed in claim 7, wherein the step of measuring said passage interval, inclination, and lateral shift of each paper sheet further includes the step of calculating the lateral shift ($Y_0$) of the paper sheet in question in accordance with the following equations:

$$Y_0 = \frac{\sum_{i=1}^{n} y_i}{n} - \alpha \cdot \frac{\sum_{i=1}^{n} x_i}{n}$$

$$Y_2 = \frac{2 \cdot Y_0 + h}{2}$$

where $Y_0$=the distance from a measuring end of said displacement detecting means to one side edge of the paper sheet to be measured, $Y_2$=the distance between said measuring end of said displacement detecting means and the centerline of said paper sheet to be measured, $h=\alpha \cdot L$, and L=the length of the paper sheet.

9. A displacement detection device for detecting the displacement of paper sheets in transit along a conveyor, comprising:

(a) sensing means for sensing the leading edge of the paper sheet in question;

(b) displacement detecting means provided downstream of said sensing means at a predetermined distance spaced apart from said sensing means for detecting the conveyance state of the paper sheets;

(c) the positions of the sensing means and the displacement detection means being spaced apart by a predetermined length and a detecting portion of said displacement detection means ranging from one edge of said conveyor to a predetermined distance so as to include a maximum shift of the paper sheets to be detected and to measure the lateral shift and skew of the paper sheets in transit;

(d) a signal processing unit connected to said sensing means and said displacement detection means for driving same so as to detect the passage of the paper sheets; and (c) a microprocessor having a CPU, and memories and connected to said signal processing unit for performing various calculations for determining a passing interval, inclination, and lateral shift of the paper sheets in accordance with detected signals from said sensing means and displacement detection means.

10. The displacement detection device as claimed in claim 9, wherein the distance $Y_0$ between one measuring end of said displacement detection means and a reference line of one edge of a paper sheet and the distance $Y_2$ between the one measuring end of said displacement detection means and the centerline of the paper sheet is determined by the following equations:

$$Y_0 = \frac{\sum_{i=1}^{n} y_i}{n} - \alpha \cdot \frac{\sum_{i=1}^{n} x_i}{n}$$

$$Y_2 = \frac{2 \cdot Y_0 + h}{2}$$

$h = \alpha \cdot L$, and $L$ = the length of the paper sheet.

* * * * *